US008235766B2

(12) United States Patent
Melarti et al.

(10) Patent No.: US 8,235,766 B2
(45) Date of Patent: Aug. 7, 2012

(54) FULL TORSO MATERNITY GARMENT

(76) Inventors: Sabina Melarti, Duluth, GA (US); Valerie Caron, Atlanta, GA (US)

( * ) Notice: Subject to any disclaimer, the term of this patent is extended or adjusted under 35 U.S.C. 154(b) by 510 days.

(21) Appl. No.: 12/432,206

(22) Filed: Apr. 29, 2009

(65) Prior Publication Data

US 2009/0270012 A1 Oct. 29, 2009

Related U.S. Application Data

(60) Provisional application No. 61/048,841, filed on Apr. 29, 2008.

(51) Int. Cl.
*A41C 1/00* (2006.01)

(52) U.S. Cl. ..... 450/155; 450/96; 2/69

(58) Field of Classification Search ..... 450/155, 450/96–100; 2/228, 227, 238, 69, 67, 237, 2/211, 212, 214
See application file for complete search history.

(56) References Cited

U.S. PATENT DOCUMENTS

| | | | | |
|---|---|---|---|---|
| 4,789,372 | A * | 12/1988 | Wicks | 450/155 |
| 5,094,648 | A | 3/1992 | Turner | |
| 5,702,286 | A | 12/1997 | Seering et al. | |
| 5,915,531 | A | 6/1999 | Hilpert et al. | |
| 5,916,531 | A * | 6/1999 | Pan | 422/211 |
| 5,928,059 | A * | 7/1999 | Wicks | 450/155 |
| 6,817,034 | B2 | 11/2004 | Smilovic | |
| 7,008,292 | B2 * | 3/2006 | Cosentino et al. | 450/155 |
| 7,181,775 | B2 | 2/2007 | Carney | |

* cited by examiner

*Primary Examiner* — Gloria Hale
(74) *Attorney, Agent, or Firm* — Lerner, David, Littenberg, Krumholz & Mentlik, LLP

(57) ABSTRACT

A maternity garment, which provides mild support to shape a woman's body and to act as a suspender for bottoms such as pants, shorts, or skirts that may be ill fitting due to body changes as a result of pregnancy, wherein the preferred garment has at least one shoulder strap, a belly panel, a hip band, two side panels, and a back panel, and is made of high performance fabric with varying degrees of compression.

27 Claims, 4 Drawing Sheets

FULL TORSO MATERNITY GARMENT

CROSS-REFERENCE AND PRIORITY CLAIM TO RELATED APPLICATION

To the fullest extent permitted by law, the present U.S. Non-Provisional patent application claims priority to and the benefit of U.S. Provisional patent application entitled "Full Torso Maternity Garment," filed on Apr. 29, 2008, on behalf of inventors Sabina Melarti and Valerie Caron, and having assigned Ser. No. 61/048,841.

TECHNICAL FIELD

The present disclosure relates generally to maternity garments, and more specifically, to maternity garments that provide support for the body and that allow for a wearer to utilize non-maternity clothing.

BACKGROUND

Many maternity garments, especially undergarments, have been developed over the years to address various problems associated with providing appropriate clothing and support to women during pregnancy. U.S. Pat. No. 5,094,648 discloses a maternity support top with a built in bra and with a two-inch bellyband that lifts weight off of the pelvis. This garment disadvantageously focuses only on the upper torso of a pregnant woman, does not address the hip or buttock area, and has no feature to suspend any bottom garments such as pants or shorts.

Spanx® brand maternity leg wear provides undergarment support in a full-length panty hose with a non-binding waistband with under belly support. However, the Spanx® maternity leg wear is, as aptly named, leg wear, and thus cannot act as a shaper or support for the upper body. Moreover, the Spanx® maternity leg wear cannot be worn over other garments, cannot provide any suspension of other garments, and is thus disadvantageous when compared to the presently described device.

U.S. Pat. No. 5,702,286 discloses a back and abdominal support worn over the brassiere and under the panties, and with a supportive band under the tummy. Disadvantageously, this garment does not smooth and support the hip and buttock areas, but only acts as a supportive piece, not a shaping or smoothing piece.

U.S. Pat. No. 7,181,755 discloses a knit fabric band that is worn over pants that are too tight or too loose, holding them in place. The band is worn as a single layer over the tummy as it grows. The band, however, is also disadvantageous relative to the present disclosure because it does not address the torso or the back and does not act as a support function. Additionally, the band does not provide a shaping function and does not improve the woman's silhouette.

U.S. Pat. No. 6,817,034 to Smilovic discloses a full body slip that shapes and supports the torso, smoothes the thighs, buttocks, and waist, and, although the tummy panel is only supported by a narrow strip, reportedly functions as a support for the belly. Because it is a slip, however, the Smilovic garment is disadvantageously limited to being worn underneath clothing rather than on the outside. The design disadvantageously prevents the wearer from wearing pants, because the full body slip is shaped in a tubular fashion, necessarily extending and reaching far down the leg. Further, the garment does not provide any suspension of outer garments, such that it does not provide much flexibility relative to outer garments, e.g., it does not allow the woman to wear too loose or too tight clothing.

Glamourmom® brand tank tops are have a built-in bra and a longer overall length than an average tank top, wherein the tops are meant to be used as a transition nursing bra tank. The tanks are disadvantageously limited in that they do not provide any tummy support and do not shape or smooth the body.

Thus, each traditional maternity support and under garment disadvantageously targets only a specific area of the body and solves only a limited few problem areas. Therefore, a need exists for an all-in-one garment that addresses several areas, including the smoothing of a woman's profile, the improvement of her level of comfort, the provision of her needed support, and the compliment of her desired aesthetics.

BRIEF SUMMARY

Briefly described, the present device overcomes the above-mentioned disadvantages and meets the recognized need by providing a device capable of delivering mild support to shape a woman's body, and capable of performing as a suspender to hold up bottoms, such as pants, shorts, or skirts, that may be ill fitting due to body changes as a result of pregnancy.

According to its major aspects and broadly stated, the present device, in its preferred form, is a maternity garment comprising a shoulder strap, a belly panel, a hip band, side panels, and a back panel; is made of seamless, high-performance knit fabric; and has a long-length that supports and shapes a pregnant woman's body, including, but not limited to, the back, the sides, the torso, the belly, and/or the hip. The maternity garment is generally worn underneath other clothing, acting as an undergarment, and is desirably shaped like a scoop-neck tank top. Unlike a traditional tank top, however, the garment preferably "scoops" underneath the breasts, forming a "U" shape, rather than covering or otherwise placing pressure on top of the breasts.

The use of high-performance fabric and seamless technology may be incorporated into the device, in order to provide maximum comfort, smoothing of imperfections such as bulges and cellulite, and slight support in the belly and back regions, as well. The garment is thus desirably made of, however not limited to, fabric having elasticity that is knitted to various degrees of compression so as to provide the most suitable support for the particular region in which it is used. For example, the belly panel preferably has a top panel section, which comprises the area beginning underneath the bust and extending to about the top two-thirds of the belly panel, is preferably made of a low compression fabric, is soft and smooth so as to not create chafing or dig in to the woman's chest or belly, and is flexible to allow for expansion essentially without restriction as the belly grows. The use of high tech fabric, such as micro fiber or the like, optionally makes this top panel section breathable and imparts moisture wicking characteristics, making common pregnancy complaints, such as itching and excessive heat, less of a problem. A bottom panel section of the belly panel, which includes the bottom one-third of the belly panel, is preferably shaped like a half moon, and is desirably made of medium to high compression fabric so as to support the weight of the growing belly, again without restricting it.

A hip band, which preferably forms the section from underneath the belly down to across the hip area and connects through side panels and a back panel of the garment, is preferably made up of medium to high compression fabric that is desirably strong enough to keep any pants or skirts securely in position, while also firming and shaping the underlying body area. Again, this area of the device may incorporate the use of high-performance fabric, which desirably minimizes and/or eliminates any heat build-up that may be caused by the tightness of support material. The back panel and side panels are preferably made of medium compression fabric so as to desirably provide additional stability, mild lumbar support, and to improve posture. Further, the maternity garment device may include adjustable and/or detachable reinforced shoulder straps to assist in keeping a woman upright and improving posture.

The very bottom of the garment may contain a friction band, made of slip resistant material, to prevent the garment from sliding or bunching up. An alternative embodiment may contain a rib knit, though not limited to such, at the bottom, as an optional manner of ensuring a snug, comfortable fit while providing sufficient tension to act as a suspender.

The garment desirably provides smoothness to the woman's body, enhancing her profile and disguising any unsightly bulges or problem areas. This smoothing, in turn, allows the woman to comfortably wear essentially any garment, such as one that may be tight fitting or clingy without being self-conscious of such areas. The maternity garment device advantageously provides the wearer with greater flexibility in terms of clothing options, while at the same time heightening her level of confidence because the smoothing effect is preferably provided by the side panels, back panel, and hip band, and effectively addresses a plurality of problem areas, such as that around the strap of the brasserie, the area around the waistband commonly referred to as a "muffin top," the sides of the torso, and the hips.

Further, as noted hereinabove, the hip band of the garment acts and/or functions as a suspender, effectively keeping pants, shorts, or skirt in place, and thereby allowing the woman to continue to use her pre-pregnancy garments, or other clothing that may be ill-fitting, by allowing the article to remain unbuttoned during wear, yet without such falling off. Such an embodiment, with the preferred hip band, eliminates the need for a belt, which, unlike the hip band, causes tightness around the belly. The longer length feature of the maternity garment device preferably allows for the garment to remain in place, enabling the pregnant woman to move about freely, bending, stretching, et cetera, without exposing any skin and without having to constantly readjust the garment positioning.

An advantage of the present device is its ability to visibly slim the woman throughout the torso, lumbar, and hip areas, allowing her to wear slim fitting apparel during her pregnancy and without exposing unsightly bulges and cellulite.

Another advantage is that, along with the garment, the woman can wear a bra of her choice, expose her cleavage, and avoid being restricted by a built-in brassiere or top section.

Another advantage of the present device is that the hip band around the hips and the friction band cooperatively function as a suspender, allowing the woman to wear pre-pregnancy or ill-fitting clothes, without such sliding off of her body, and while concealing any exposed areas, such as visible panties when wearing pants unbuttoned.

Another advantage is that, with the use of high-tech fabrics, the garment of the present disclosure will provide a cooling effect for the pregnant woman due to the fabric's breathable and moisture wicking capabilities.

Yet another advantage is that a pregnant woman can wear the garment of the present invention for slight support of the tummy and lumbar regions.

Another advantage of the present device is that it functions as an all-in-one garment, providing support, providing lift, keeping the pants, skirt, or shorts of the wearer in place, covering any areas at risk for inadvertent exposure, and keeping the woman temperately comfortable with the use of high-tech fabrics.

A further advantage is that a woman can wear a garment of the present disclosure and not worry about exposing skin when going about her business, bending, stretching, or the like, as the tunic length covers any area to be exposed, and the tightness of the band in such area keeps the garment from sliding or bulging.

These and other features and advantages of the present device will become more apparent to those ordinarily skilled in the art after reading the following Detailed Description and Claims in light of the accompanying drawing Figures.

BRIEF DESCRIPTION OF THE DRAWINGS

Accordingly, the present disclosure will be understood best through consideration of, and with reference to, the following Figures, viewed in conjunction with the Detailed Description of the Preferred Embodiment referring thereto, in which like reference numbers throughout the various Figures designate like structure and in which.

It is to be noted that the drawings presented are intended solely for the purpose of illustration and that they are, therefore, neither desired nor intended to limit the invention to any or all of the exact details of construction shown, except insofar as they may be deemed essential to the claimed device.

DETAILED DESCRIPTION

In describing preferred embodiments of the present device illustrated in the Figures, specific terminology is employed for the sake of clarity. The device, however, is not intended to be limited to the specific terminology so selected, and it is to be understood that each specific element includes all technical equivalents that operate in a similar manner to accomplish a similar purpose.

Figure 1:
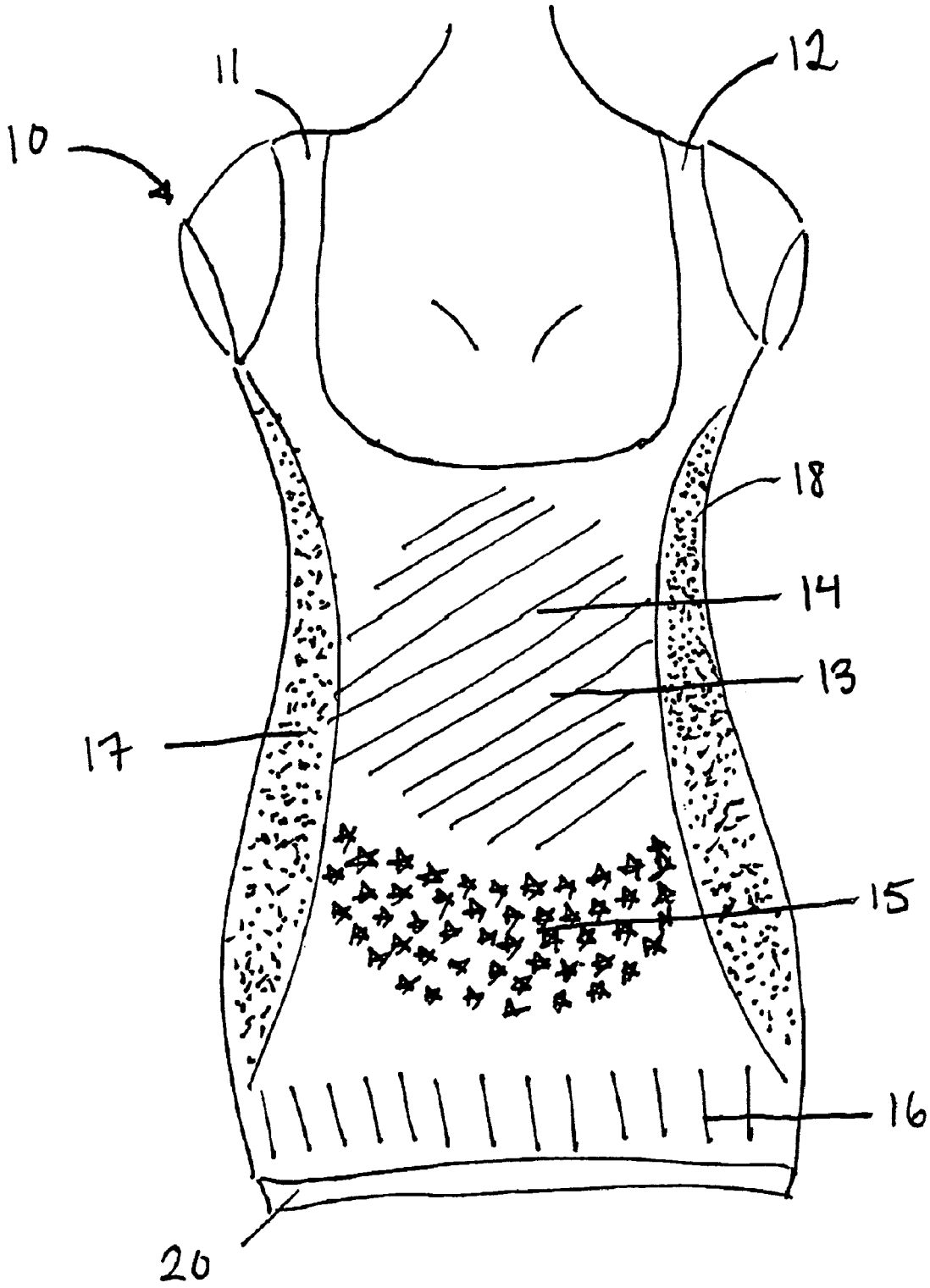
FIG. 1 is a full frontal perspective of one embodiment of the present device.
Figure 2:
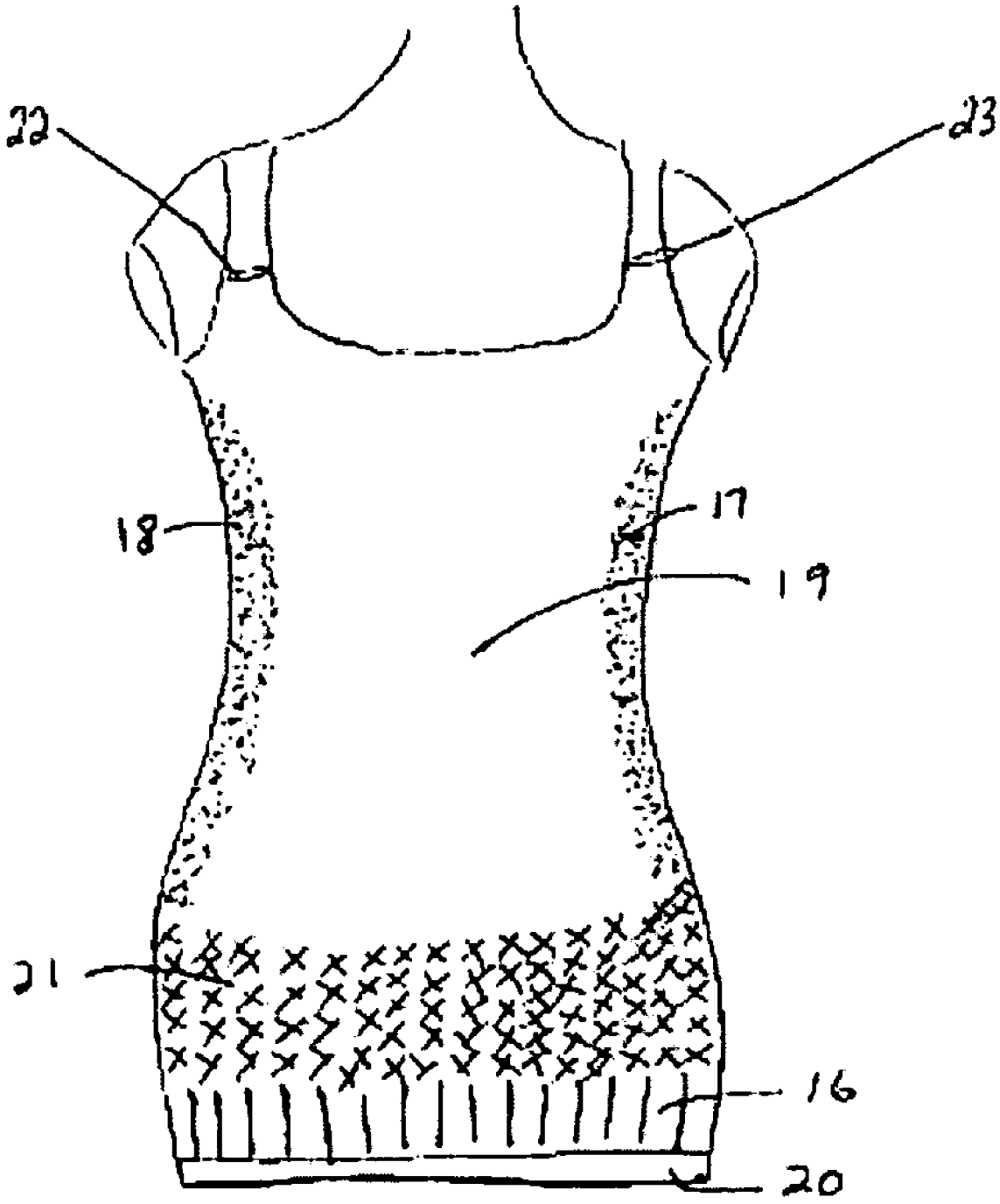
FIG. 2 is a back perspective of one embodiment of the present device.

In that form of the preferred embodiment of the present device chosen for purposes of illustration, FIGS. 1 and 2 illustrate maternity garment 10, which preferably comprises shoulder straps 11 and 12, belly panel 13 having top panel section 14 and bottom belly panel section 15, hip band 16, side panels 17 and 18, back panel 19, and optionally, friction band 20. Maternity garment 10 preferably covers a woman's belly, back, sides, and hips, extending from the shoulders down to right below the hip area. In a preferred embodiment, a woman's bust area is not covered by garment 10; that is, upper edge 50 of garment 10 is preferably positioned below a woman's breasts during wear.

With reference to FIG. 1, belly panel 13 thus preferably covers the belly of the wearer from directly under the bust, extending vertically down to immediately under the belly and extending horizontally to side panels 17 and 18 on each side of the belly. Belly panel 13 desirably adapts to the changing proportions of woman's body and expands for maximum comfort. Any fabrics having the appropriate compression and/or elasticity as further described below could be used, such as, and without limitation, Lycra®, Nylon®, micro denier, polyester, cotton/polyester blend or the like, including any blends thereof.

In the preferred embodiment of the current invention, top panel section 14, which preferably encompasses the top two-thirds of belly panel 13 from an area beginning underneath the breasts and extending to preferably about three inches above the belly button, may be comprised of low compression or low reinforcement fabric having elasticity so as to allow for the fabric to stretch in order to provide maximum comfort for the woman and to allow room for normal growth without restriction of or delivery of pressure to the belly. The preferred material desirably contains moisture-wicking capabilities and is breathable, making common pregnancy itching less of a problem, thus ensuring comfort.

Bottom belly panel section 15, which preferably encompasses the bottom one-third of belly panel 13, is preferably crescent-shaped, like a half-moon. This preferred shape is optimal as it lifts and cradles the belly much as a sling would, and desirably alleviates some discomforts caused by the weight and pressure of the growing belly. To ensure such support and lift, bottom belly panel section 15 is preferably made of fabric with a targeted, higher degree of compression relative to top panel section 14, thereby providing medium compression or medium reinforcement. This medium compression may be obtained by utilizing a fabric with tighter knitting relative to top panel section 14.

In addition, the transition from top panel section 14 to the bottom panel section 15 is preferably made smooth by the use of seamless technology. A seamless transition advantageously means a smoother silhouette underneath other garments as there are no visible seams, and further means an elimination of uncomfortable chafing or itching that may be caused by seams. It is understood that one having ordinary skill in the art can chose a proper fabric and degree of compression, or combination thereof, in order to ensure the preferred and proper support and comfort. Preferably, however, the fabric should generally have moisture wicking capabilities for cooling and compression capabilities for proper support.

In an alternative embodiment, entire belly panel 13 may be made of low compression fabric with elasticity to provide stretch for comfort and for the maximum ability to adapt to the expanding belly, thereby allowing the pregnant woman to wear the garment from the early stages of pregnancy until the very end.

In another alternative embodiment, entire belly panel 13 may be made of high compression fabric or two-ply fabric, with elasticity to provide control and shaping for the post-partum body. It is understood that one having ordinary skill in the art can select the proper material most suitable for the needed support and comfort for the intended term of wear of the garment.

With continued reference to FIGS. 1 and 2, side panels 17 and 18, which generally and preferably extend vertically from underneath the arms of the wearer to hip band 16 and horizontally from the sides of belly panel 13 and to the sides of back panel 19, are optimally made of, however not limited to, medium to high compression fabric so as to generally provide mild support and stability. It should be noted that side panels 17 and 18 and back panel 19 may be integrally related, may be of the same level of compression, may differ in compressive characteristics, and/or may simply be connected together. As with the other garment fabric components, the fabric of side panels 17 and 18 desirably has elastic qualities, as well as moisture wicking and compression capabilities so as to provide the needed support while wicking moisture from the body and keeping the woman cool. In an alternative embodiment, as is understood by one having ordinary skill in the art that other fabrics with varying degrees of compression may be used so as to provide varying degrees of support, wherein it is preferred that side panels 17 and 18, in addition to providing support and stability, serve to smooth the woman's sides, concealing any imperfections, such as, for example, cellulite, unsightly bulges caused by weight gain, or created by other garments that "dig" into the body, such as brassieres and pants or skirts, thus making the body appear more aesthetically pleasing while garment 10 is being worn.

Back panel 19, as referenced in FIG. 2, preferably connects to side panels 17 and 18, hip band 16, and shoulder straps 11 and 12 in the back of garment 10. Back panel 19 is generally and preferably made of medium to high compression fabric having elastic qualities and moisture wicking and compression capabilities. The compression desirably provides mild support for the back and relieves tension created by the growing belly. In addition to providing support, back panel 19 desirably smoothes the woman's back, making it easier for her to coordinate garment 10 with her outer garments, and also enhancing her profile.

In an alternative embodiment of the present device, back panel 19 may contain lumbar panel 21 for additional support and stability, which would generally be located near the bottom of back panel 19 of garment 10, and would generally be extending from around the hipbone to the middle of the back. Lumbar panel 21 would desirably be made of a high compression fabric so as to provide a maximized degree of support and stability, as well as to promote proper posture, which is necessary during pregnancy to avoid back and other pain. Again, the fabric would optimally and preferably have elastic qualities and moisture wicking and compression capabilities. Lumbar panel 21 may be knitted to various degrees of compression in various areas so as to provide optimal support. It is understood by one having ordinary skill in the art that various materials with varying degrees of compression and knitting could be used in order to secure the proper support.

Figure 4:
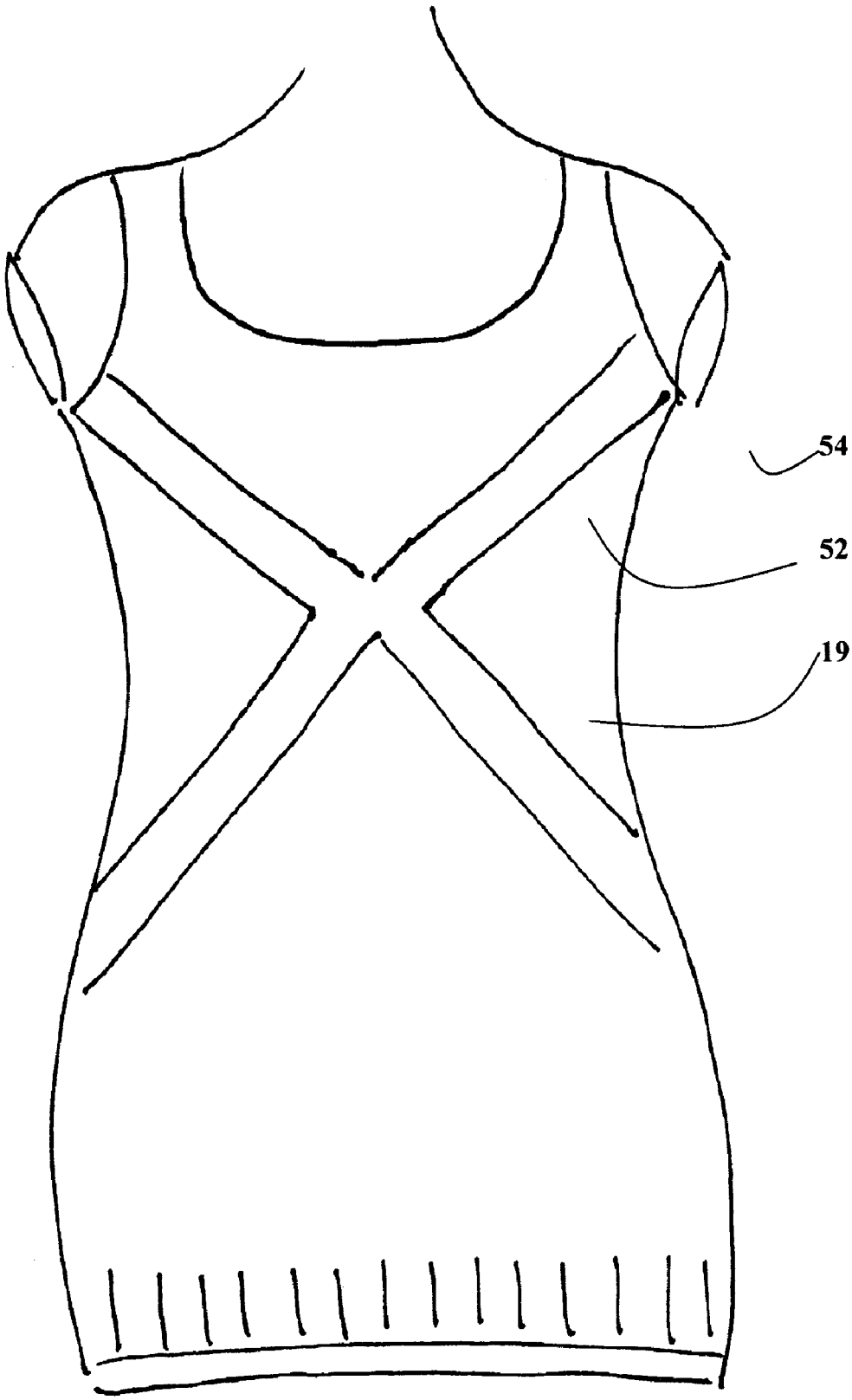
FIG. 4 is a rear view of an alternative embodiment of the present device.

In another embodiment, such as depicted in FIG. 4, band 15 extends from under belly panel 13 around to back panel 19 to define X-shaped support panel 52, wherein X-shaped support panel 52 connects to armpit area 54. Accordingly, X-shaped support panel 52 serves as an anchor to lift and support the belly, while also distributing the weight to alleviate stress on the back of the wearer. In such manner, posture is also assisted and/or improved as a result of the pulling back of the shoulders by the weight distribution.

Figure 3:
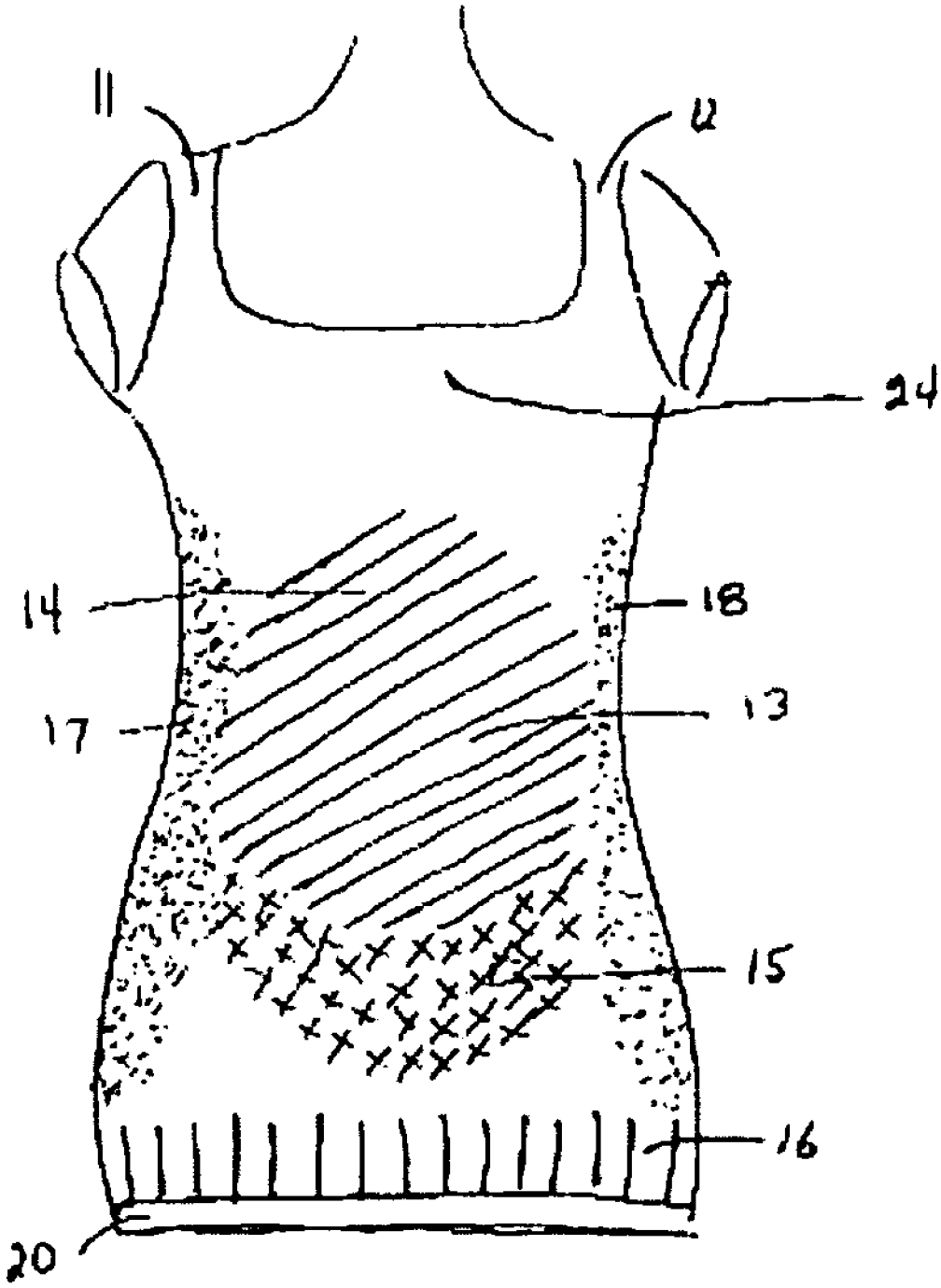
FIG. 3 is a full frontal perspective of an alternative embodiment of the present device.

As depicted in FIGS. 1 and 3, preferably, attached at the bottom of garment 10 is hip band 16, which is preferably a tubular shaped panel that serves to smooth the hip and upper thigh area, while at the same time acting as a suspender, ensuring that any bottom garment used, such as pants, shorts, or skirts, stay put in position without the use of a belt or other suspending device. Hip band 16 allows the woman to extend the use of her pre-pregnancy or pregnancy clothing as it allows her to wear such garments unbuttoned and/or unzipped without the garments sliding down. Hip band 16 additionally serves as a cover up because it conceals not only imperfections on the woman's body, but also the fact that her bottom garment may be unbuttoned. Hip band 16 is therefore preferably taut enough to lift and suspend articles of clothing and to conceal any flaws on the body, while also ensuring that the bulk or exposure of undergarments caused by unbuttoned bottoms goes unnoticed, and, all the while remaining wearably comfortable for the pregnant woman. Hip band 16 may be generally constructed using fabric having elasticity and moisture wicking and compression capabilities. It is preferable that fabric be of medium to high compression so as to ensure proper suspension, smoothing, and lift, while ensuring comfort. Hip band 16 may alternatively be made of the same fabric as back panel 19, wherein in such an embodiment, neither would be a separate entity. To one having ordinary skill in the art, it is understood that various fabrics having elasticity may be used in the construction of hip band 16, and that any persons having expertise in the field can decide which type of fabric and level of compression is most suitable in order to serve the three preferred purposes as mentioned above.

In another preferred embodiment, friction band 20 may be attached to the bottom of hip band 16. Friction band 20 preferably serves to ensure that the entire garment 10 stays put where desired; that is, pulled down for longer length or higher up on the hip, for example. Friction band 20 allows more flexibility in the use of garment 10, essentially converting it back and forth from a longer to a shorter length, as dictated by the woman's needs and desires, allowing her to, for example, wear a shorter length top when wearing the present embodiment underneath as a longer length garment, or vice versa. Friction band 20 is generally made of a slip-resistant material and preferably having elastic qualities, such as for example silicone. To one having ordinary skill in the art it is understood that various materials with elasticity may be used so as to ensure proper resistance without restriction on the body. In an alternative embodiment, friction band 20 may be created using seamless technology. A tighter knit or higher compression fabric is preferably used to create the friction needed to keep garment 10 in place. It is desirable that friction band 20 be attached to garment 10 in a seamless fashion so as to avoid any additional bulk and to ensure a comfortable, smooth silhouette; however, it is considered that an appropriately strong yet concealed and/or concealable seam may alternately be utilized.

With reference to FIG. 1, shoulder straps 11 and 12 preferably support the garment and are optionally adjustable and detachable, as may be seen, for example, in FIG. 3. Shoulder straps 11 and 12 are desirably and preferably made out of a medium-compression, high-performance, reinforced fabric with moisture wicking capabilities so as to provide proper support of garment 10 and ensure ultimate comfort due to, again, proper support as well as the fabric's capacity to release rather than to trap moisture. To one having ordinary skill in the art, it is understood that various material could be used in various combinations to provide the desired support and comfort.

In another embodiment, shoulder straps 11 and 12 may be reinforced to varying degrees and may contain padding in one or more area, and may be made of man-made or nature-made fabric suitable for such. Shoulder straps 11 and 12 may be made from any material, and preferably with opaque qualities, such as rubber, silicone or the like, so that a woman may wear additional articles of clothing without the desired embodiment of the present invention showing through shear fabrics or the like. Shoulder straps 11 and 12 might optionally contain slip resistant material, such as rubber, silicon or the like, for traction to ensure that shoulder straps 11 and 12 remain in place, as selectively positioned by the wearer. Shoulder straps 11 and 12 may be generally flat, shaped in a round fashion, may be twinned, or the like, or any selected or preferred shape or conformation as appropriate. Shoulder straps 11 and 12 are preferably about one (1) inch wide; however, to one having ordinary skill in the art it would be understood that narrower or wider shoulder straps may also be used in order to provide the desired support and comfort. In an alternative embodiment, shoulder straps 11 and 12 may vary in width in different places. For example, the shoulder panel segment may be wider than the rest of the width of shoulder straps 11 and 12 so as to provide additional support in the shoulder area without the extra bulk of fabric around the armpit and bust regions.

In an alternate embodiment, shoulder straps 11 and 12 may be adjustable so that a woman may adjust the garment according to her desired level of support as her bust and belly expand throughout the pregnancy. Also in an alternative embodiment, shoulder straps 11 and 12 may be detachable so that the woman may remove shoulder straps 11 and 12 at any time according to her needs or desires, such as for example, when wearing a strapless dress over garment 10 or perhaps a nursing bra on top of which she does not want any additional bulk. Shoulder straps 11 and 12 may be generally convertible so as to allow the woman to wear garment 10 as a two-strap, halter, criss-cross back, criss-cross front, or strapless, with the strapless alternative optionally having a slip resistant band made of materials such as silicone or rubber in order to keep garment 10 from sliding down. This selective adaptivity would function to accommodate each pregnant woman's personal needs and desires. She may chose the strapless option as it does not interfere with her own brassiere, or she may chose the criss-cross back option because to her it provides more support and alleviates her discomforts. The convertible nature of shoulder straps 11 and 12 would also serve to accommodate the woman's size and support requirements and preferences, while still allowing for flexibility with outerwear.

In the preferred embodiment, shoulder straps 11 and 12 are desirably attached to garment 10 in a seamless fashion to prevent any discomfort that may be caused by stitching. In an alternative embodiment, shoulder straps 11 and 12 may be attached to garment 10 with the use of stitching, seams, anchors, buckles, and/or any other appropriately performing and comfortable manner in order to accommodate if seamless manufacturing is not possible or not selected for the particular configuration. In the preferred embodiment, the edges of shoulder straps 11 and 12 are desirably seamless, yet not limited to such, for comfort and to minimize bulk when wearing multiple layers. The preferred embodiment has two shoulder straps 11 and 12; however, in an alternative embodiment, multiple shoulder straps on each side of garment 10 may be used so as to enhance comfort and support.

Referring to the illustrations, in particular FIG. 2, clasps 22 and 23 are preferably located in the back of garment 10, such as where shoulder straps 11 and 12 meet back panel 19 of garment 10, so as to allow for the adjusting function without sacrificing comfort, as it is recognized that such clasps 20 and 21 may potentially create additional bulk, depending upon particular design thereof. In an alternative embodiment, clasps 22 and 23 may be located in the front, positioned slightly above the bust, to provide easy access for the pregnant woman who may find it hard to reach behind her back to adjust garment 10. Clasps 22 and 23 may be alternatively located at the sides of the bust, with such encompassing any area from below to the top of the bust, to, again, provide easy access for the pregnant woman while being slightly hidden as it is positioned to the side so as to avoid bulk in the region directly above the bust, thus increasing comfort. In a further alternative embodiment, garment 10 may contain any number of clasps in one or more position and/or location, or garment 10 may not contain any clasps in order to provide ultimate comfort due to the smooth nature of the strap when without hardware. In the preferred embodiment, as shown in FIG. 2, clasps 20 and 21 are desirably made of, but not limited to, any plastic or metallic material, but any suitable material may be utilized, including sturdy fabrics or any other synthetic or natural material or combination thereof.

As illustrated in FIG. 1, the preferred embodiment does not contain material to cover the breasts. This exposes the wearer's breasts, which in turn means less compression on the breasts, greater accessibility for nursing mothers to unsnap their nursing brassiere, fewer layers of clothing, as well as having the choice to wear any top article of clothing as garment 10 will not interfere with any particular styles, such as for example deep-cut garments. Garment 10 desirably defines and/or takes the shape of a scoop-tank, with shoulder straps 11 and 12 connect to garment 10 at side panels 17 and 18 underneath of the breasts, forming the shape of the letter U. In an alternative embodiment, such as shown in FIG. 3, garment 10 may contain bust panel 24 made of fabric to cover the breasts. Bust panel 24 would add support necessary for bigger busted women while also allowing a woman to wear garment 10 by itself rather than underneath additional clothing, thus creating less bulk and heat, and in turn increasing comfort. It is understood one having ordinary skill in the art can select the proper dimensions for the area covering the breasts in order to provide the proper support and comfort. Bust panel 24 may be of any desired shape, such as the letter U, the letter V or any other shape that may be deemed suitable. The different shapes will allow for different support options while enhancing comfort. Bust panel 24 is preferably made of materials having elastic qualities with compression capabilities so as to provide the most comfort and support, such as Nylon®, Lycra®, Spandex®, Coolmax®, and cotton and/or man-made yarns having elastic components and compression capabilities would be generally suitable to support the breasts. Additionally, bust panel 24 could be detachably engaged with garment 10, such as via snaps, hook and loop fastener, snap lock seaming, or the like, in order to allow for selective wear and/or removal.

In another alternative embodiment, bust panel 24 may include a brassiere (not shown) which may be attached to garment 10 by means generally known to one having ordinary skill in the art. The brassiere may be shaped similarly to that of a sports brassiere, in which another layer of fabric is used that is cut in a similar fashion to that of bust panel 24. The additional fabric would generally line garment 10 around the breasts and extend/circle around to the back upper torso region of garment 10. The brassiere may alternatively be shaped in the form of a demi cup, push up, wireless, racer back, strapless, plunge, or full coverage style so as to accommodate the various support and comfort needs of different women, while also allowing for greater flexibility when choosing outer garments, which sometimes require different brassiere options. The brassiere may also include molded under wire to provide additional support and to lift the breasts, such as to reduce sagging and in turn reduce stretching and discomfort of the breasts. The under wires may optionally be knitted for increased comfort and to avoid bulk. If the woman is wearing an unattached and personally selected brassiere underneath the present device, knitted under wire would likely create less compression than a molded under wire, would serve to reduce bulk in that particular region and would in turn create more comfort and less pressure on the breasts and ribs.

In another embodiment, reinforced panels and/or pads may be incorporated in to bust panel 24 to provide additional support and lift of the breasts. Bust panel 24 may additionally contain molded, seamless smooth cups to provide hidden support in order to avoid need for additional brasserie. This option provides a high degree of comfort and the choice of whether or not to wear a brasserie. Reinforced panels and/or pads may further include removable and/or disposable nursing pads, such as for convenient continued use of garment 10 during post-pregnancy term.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is at least:

1. A maternity garment comprising:

at least one shoulder strap;

a belly panel connected with the shoulder strap and including a top panel section disposed toward the at least one shoulder strap and a bottom panel section remote from the at least one shoulder strap;

a hip band extending from the belly panel opposite the at least one shoulder strap;

two side panels extending from the belly panel between the at least one shoulder strap and the hip band; and a back panel disposed between the two side panels opposite the belly panel;

wherein said maternity garment is dimensionally configured to cover the torso of a wearer, extending through the hips, and wherein said maternity garment is made of at least one resiliently stretchable material configured to provide a smoothing effect to the physical appearance of the wearer by compression, and wherein said belly panel is constructed to deliver a multiple degrees of compression at least by configuring said top panel section to provide a first compression and configuring said bottom panel section to provide a second degree of compression that is greater than said first degree of compression.

2. The maternity garment of claim 1, wherein said hip band is configured to provide a compression characteristic over the hips of the wearer, the compression characteristic being sufficient to hold a waist-worn garment in place between the hip band and the hips of the wearer by friction caused at least partially by the compression characteristic, said waist-worn garment selected from the group consisting of pants, skirt, shorts, or capris.

3. The maternity garment of claim 1, further comprising a friction band of a slip-resistant material attached to said hip band to prevent slippage of said maternity garment by friction against one of the skin of the wearer or a garment disposed between the friction band and the wearer.

4. The maternity garment of claim 1, further comprising a lumbar panel located on a lower portion of said back panel.

5. The maternity garment of claim 1, wherein said at least one strap further comprises a clasp.

6. The maternity garment of claim 1, wherein said garment does not cover the breasts of the wearer.

7. The maternity garment of claim 1, further comprising a bust panel.

8. The maternity garment of claim 1, wherein said garment is seamless.

9. The maternity garment of claim 1, wherein said material of said garment is selected from the group consisting of spandex Lycra®, Nylon®, micro denier, polyester, or cotton/polyester blend.

10. A garment, comprising:

a wearable article adapted to be worn at a position proximate the bottom of the breast of the wearer and extending at least to the hips of the wearer, the article including a U-shaped front panel peripheral edge defined proximate an upper edge of said wearable article, wherein said U-shaped front panel peripheral edge is adapted to scoop underneath the breasts of the wearer, said wearable article further comprising, means for delivering at least a minimum of shaping support to a woman's body, and means for performing a suspender function.

11. The garment of claim 10, wherein said wearable article further comprises a belly panel, a hip band, a plurality of side panels and a back panel.

12. The garment of claim 10, further comprising one or more straps.

13. The garment of claim 11, wherein said belly panel further comprises a top panel section and a bottom panel section, and wherein said top and bottom panel sections differ in compressive characteristics.

14. The garment of claim 13, wherein said bottom panel section is generally crescent shaped.

15. The garment of claim 11, wherein said hip band is adapted to extend from said belly panel and across the hips of the wearer, and wherein said hip band connects through said plurality of side panels and to said back panel.

16. The garment of claim 10, wherein said means for delivering said at least a minimum of shaping support to a woman's body is a compression fabric having one or more levels of compression.

17. The garment of claim 15, wherein said means for performing a suspender function is said hip band, said hip band being configured to provide a compression characteristic over the hips of the wearer, the compression characteristic being sufficient to hold a waist-worn garment in place between the hip band and the hips of the wearer by friction caused at least partially by the compression characteristic.

18. The garment of claim 12, wherein said one or more straps are selected from the group consisting of adjustable straps, detachable straps, opaque straps, slip resistant straps, flat straps, rounded straps, twinned straps, multi-width straps, padded straps, convertible straps, halter straps, criss-cross back straps, or criss-cross front straps.

19. The garment of claim 10, further comprising a friction band proximate a bottom edge of said garment.

20. The garment of claim 10, wherein said belly panel, said hip band, said plurality of side panels and said back panel are seamlessly related.

21. A garment, comprising:

a wearable article adapted to be worn at a position proximate the bottom of the breast of the wearer and extending at least to the hips of the wearer;

a U-shaped front panel peripheral edge defined proximate an upper edge of said wearable article, wherein said U-shaped front panel peripheral edge is adapted to scoop underneath the breasts of the wearer;

a front panel adapted for wear proximate a region defined by said U-shaped front panel peripheral edge;

means for delivering at least a minimum of shaping support to a woman's body, and means for performing a suspender function.

22. The garment of claim 11, further comprising a lumbar panel, said lumbar panel positioned proximate said back panel.

23. The garment of claim 11, further comprising an X-shaped support panel positioned proximate said back panel.

24. The garment of claim 21, wherein said front panel is removable.

25. The garment of claim 21, wherein said front panel is further adapted with a bra.

26. The garment of claim 25, wherein said bra includes first and second cups configured as cups from a bra selected from the group consisting of a sports bra, a demi-cup bra, a push-up bra, a wireless bra, an underwire bra, a racer back bra, a plunge bra, a molded bra, or a full coverage bra.

27. The garment of claim 21, wherein said front panel further comprises an interior element selected from the group consisting of reinforced panels, reinforced pads, molded and seamless cups, or nursing pads.

* * * * *

UNITED STATES PATENT AND TRADEMARK OFFICE

CERTIFICATE OF CORRECTION

PATENT NO. : 8,235,766 B2
APPLICATION NO. : 12/432206
DATED : August 7, 2012
INVENTOR(S) : Sabina Melarti and Valerie Caron It is certified that error appears in the above-identified patent and that said Letters Patent is hereby corrected as shown below:

In the Specification

Column 1, line 27, “built in” should read --built-in--
Column 1, line 35, “under belly” should read --under-belly--
Column 2, line 3, delete the word “are”
Column 2, line 49, “in to” should read --into--
Column 3, line 47, “slim fitting” should read --slim-fitting--
Column 5, line 38, “moisture wicking” should read --moisture-wicking--
Column 5, line 66, “moisture wicking” should read --moisture-wicking--
Column 6, line 2, after “art” insert --,--
Column 6, line 3, delete the word “that”
Column 6, line 16, “moisture wicking” should read --moisture-wicking--
Column 6, line 33, “moisture wicking” should read --moisture-wicking--
Column 6, line 50, “cover up” should read --cover-up--
Column 6, line 58, “tubular shaped” should read --tubular-shaped--
Column 6, line 67, “moisture wicking” should read --moisture-wicking--
Column 7, line 9, “is” should read --are--
Column 7, line 41, “moisture wicking” should read --moisture-wicking--
Column 8, line 62, “position” should read --positions--
Column 9, line 7, “brassiere” should read --brassieres--
Column 9, line 12, “connect” should read --connected--
Column 9, line 20, after “one” insert the word --that--
Column 9, line 45, “demi cup” should read --demi-cup--
Column 9, line 51, “under wire” should read --under-wire--
Column 9, line 53, “under wires” should read --under-wires--
Column 9, line 57, “under wire” should read --under-wire--
Column 9, line 58, “under wire” should read --under-wire--
Column 9, line 62, “in to” should read --into--

Signed and Sealed this
Twentieth Day of May, 2014

Michelle K. Lee

Michelle K. Lee
*Deputy Director of the United States Patent and Trademark Office*

In the Claims

Column 10, line 32, delete the word “a”
Column 11, line 19, “crescent shaped” should read --crescent-shaped--
Column 11, line 37, “slip resistant” should read --slip-resistant--
Column 12, line 32, “racer back” should read --racer-back--